US006460739B1

(12) United States Patent
Norris et al.

(10) Patent No.: US 6,460,739 B1
(45) Date of Patent: Oct. 8, 2002

(54) DISPENSER

(75) Inventors: Joseph T. Norris, West Windsor, NJ (US); John C. Crawford, Mahopac, NY (US); Patrick M. Calello, Roseland, NJ (US)

(73) Assignee: Colgate-Palmolive Company, New York, NY (US)

( * ) Notice: Subject to any disclaimer, the term of this patent is extended or adjusted under 35 U.S.C. 154(b) by 0 days.

(21) Appl. No.: 09/683,313

(22) Filed: Dec. 13, 2001

(51) Int. Cl.[7] ..... B67D 5/42
(52) U.S. Cl. ..... 222/380; 222/383.1; 222/95
(58) Field of Search ..... 222/95, 380, 383.1

(56) References Cited

U.S. PATENT DOCUMENTS

| | | | | |
|---|---|---|---|---|
| 4,684,044 A | | 8/1987 | Foster | 222/386 |
| 4,691,847 A | | 9/1987 | Ford et al. | 222/259 |
| 4,715,518 A | | 12/1987 | Moore | 222/257 |
| 4,821,926 A | * | 4/1989 | Battegazzore | 222/380 |
| 4,872,596 A | | 10/1989 | Corsette | 222/380 |
| 4,886,186 A | * | 12/1989 | Andris | 222/383.1 |
| 4,890,773 A | | 1/1990 | Corsette | 222/380 |
| 5,104,009 A | * | 4/1992 | Battegazzore | 222/380 |
| 5,176,291 A | * | 1/1993 | Fillmore et al. | 222/380 |
| 5,271,534 A | * | 12/1993 | Fillmore et al. | 222/383.1 |
| 5,465,873 A | | 11/1995 | Mejean et al. | 222/47 |
| 5,577,640 A | * | 11/1996 | Albini et al. | 222/380 |
| 5,617,976 A | * | 4/1997 | Gueret | 222/380 |
| 6,047,862 A | * | 4/2000 | Davies | 222/380 |

FOREIGN PATENT DOCUMENTS

| | | | |
|---|---|---|---|
| EP | 436811 A1 * | 7/1991 | B65D/83/00 |
| WO | WO 9117098 A1 * | 11/1991 | B65D/83/00 |

* cited by examiner

*Primary Examiner*—Kenneth Bomberg
(74) *Attorney, Agent, or Firm*—Michael J. McGreal

(57) ABSTRACT

The dispenser is for dispensing viscous products, has an ergonomic shape, and an automatic closure. The closure opens promptly upon initiation of an actuator and before the flow of viscous product from the dispenser. Further, the closure closes the dispenser outlet at the end of the return of the actuator to its rest position. Further, an outlet valve from a pump chamber remains open as an inlet valve to the pump chamber opens. This causes a suckback of viscous product near the dispenser outlet to flow into the dispenser. The automatic closure does not close as dispenser outlet until the suckback of viscous product has occurred. The automatic closure also functions as a knife or blade to assist in cutting the viscous product to maintain cleanliness and hygiene of the package.

13 Claims, 7 Drawing Sheets

DISPENSER

BACKGROUND OF INVENTION

This invention relates to a dispenser for viscous or viscous products, which has a closure, which closure automatically closes the dispenser exit. More particularly, this invention relates to a dispenser having a closure where the closure opens before the flow of viscous product and closes after the flow of viscous product. The closure acts as a door or knife to assist in cutting off the product flow to maintain cleanliness.

These are a variety of dispensers for viscous products (viscosity range 150,000–600,000 CPS), which include a closure for the exit. Such a closure is used for hygienic reasons to keep the viscous product isolated from the environment when the dispenser is not in use. Such a closure could be one that is opened and closed manually. The closure could be threaded onto dispenser exit or attached to the dispenser and opened via a hinge. However, in all of these embodiments a person would have to remember to put the closure in place after use. It is preferred that the closure be automatically activated to open and close the dispenser exit when the dispenser is actuated, and in addition assist in product cutoff.

Dispensers that have automatically opening and closing closures for a dispensing outlet are disclosed in U.S. Pat. No. 4,684,044; U.S. Pat. No. 4,691,847; U.S. Pat. No. 4,715,518 and U.S. Pat. No. 4,872,596. In several of these patents the closure over the dispensing outlet also functions as a valve that is necessary for the operation of the dispenser. In the present dispenser the pump valves are located within the pump body with the closure solely being for sanity purposes and to keep the product at the dispenser opening from drying out and forming a crust at the dispenser outlet, and stopping product flow in a clean manner by assisting product cutoff.

SUMMARY OF INVENTION

The present dispenser has an ergonomic shape and is of the type where the outlet of the dispenser is automatically covered by a closure when the dispenser is not in use and is being stored. An objective is to have the outlet of the dispenser covered for sanitary reasons, to prevent the product in the area of the outlet from drying out and forming a crust or dried plug at the outlet exit. Another is for the closure to assist in the cutoff of any part of the product as the main charge of viscous product is being sucked back into the dispenser upon the cessation of dispensing.

The ergonomic shape is to make the dispenser easy to grip and to hold in one hand, and to operate using one hand. This alone provides a clear difference compared to current package forms for dispensing viscous products.

The dispenser is comprised of a product chamber and a pump chamber. The product chamber will, in one embodiment, be unitary with the dispenser and in another embodiment be a refill container that can be inserted into the dispenser to replace a container from which all of the product has been dispensed. A refill container would be inserted into the dispenser through the bottom of the dispenser.

The dispenser is comprised of a body with a supporting base at a lower end. On the upper end there is a dispensing outlet and adjacent the dispensing outlet, an actuator. The dispenser outlet is closed by a pivoting outlet door closure. Upon depressing the pump actuator the outlet door closure is pivoted open prior to the initiation of product flow from the dispenser. It remains open during dispensing and closes after dosing of the product has been completed. However, it does not close until a portion of the product has been drawn back down into the dispenser, i.e, sucked back, by the internal valving system. This will assist the closure as it moves to close the dispensing outlet. The closure also will cutoff product any portions of the product that have not flowed back into the dispenser.

Upon actuation of the dispenser, by depressing the actuator, product in the pump chamber is expelled from the pump chamber past the pump chamber outlet valve, through the outlet channel and outlet channel extension to the outlet opening. As the actuator is being depressed, a closure covering the outlet opening immediately is opened. This closure is opened prior to the flow of product from the dispenser. After the opening of the closure, a portion of the product is dispensed from the dispenser. Upon release of the actuator, the flow of product ceases and some of the product is sucked back down into the dispenser from the region of the dispenser outlet prior to the closure closing. There is a delay in the closing of this closure to preclude contact of the closure with the viscous product being dispensed. This is accomplished by keeping the pump chamber outlet valve open during part of the return of the actuator to its rest position and the structure of the connection of the actuator to the closure. The release of the actuator returns it to the upright position and refills the dispensing chamber with the next dose or product.

DETAILED DESCRIPTION

The dispenser will be described in more detail with reference to the drawings. The figures disclose the dispenser in its preferred embodiments with modifications being within the present concept.

Figure 1:
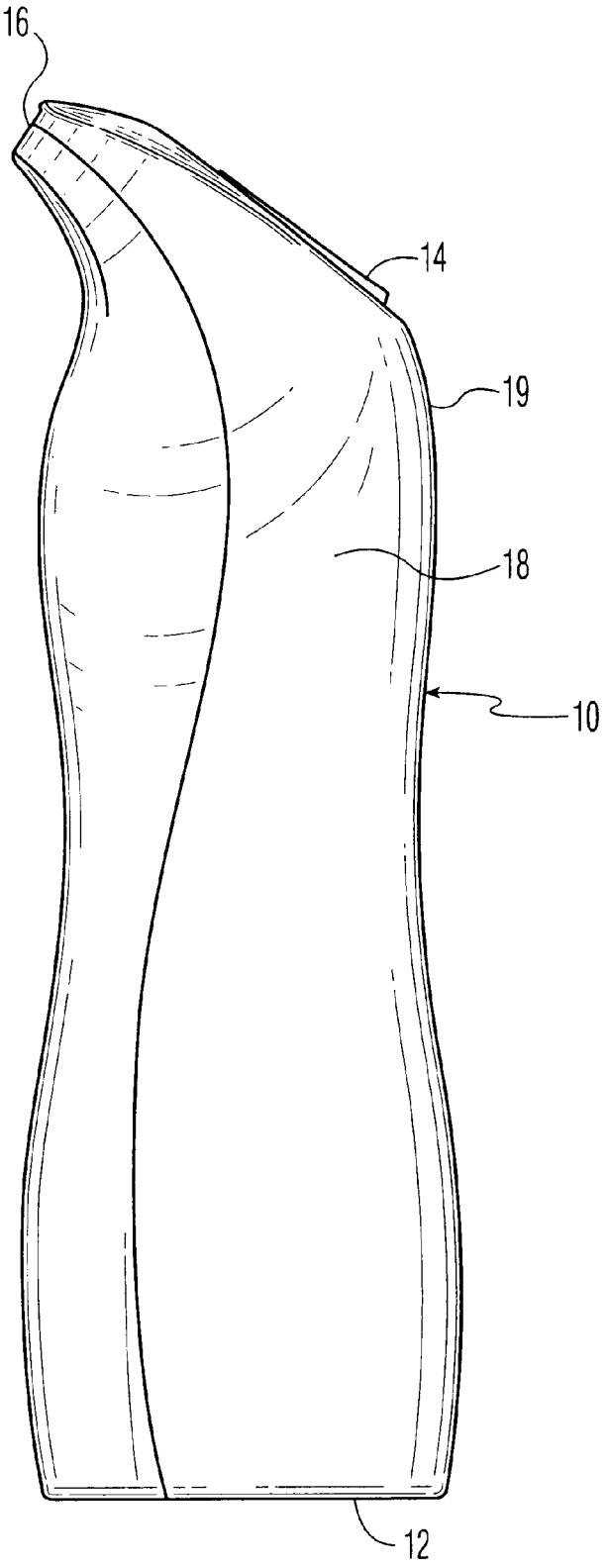
FIG. 1 is a side elevation view of the dispenser.
Figure 2:
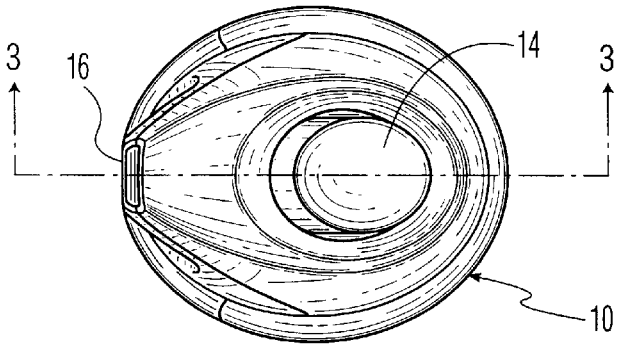
FIG. 2 is a top plain view of the dispenser.

The dispenser 10 of FIG. 1 has an ergonomic shape to the sidewalls 18 of the dispenser. This ergonomic shape makes the dispenser easier to hold and to use in a one handed manner. The dispenser has a base 12, dispensing outlet port 16 and an actuator button 14. The dispensing outlet 16 and actuator button are better shown in the top plan view of FIG. 2.

Figure 3:
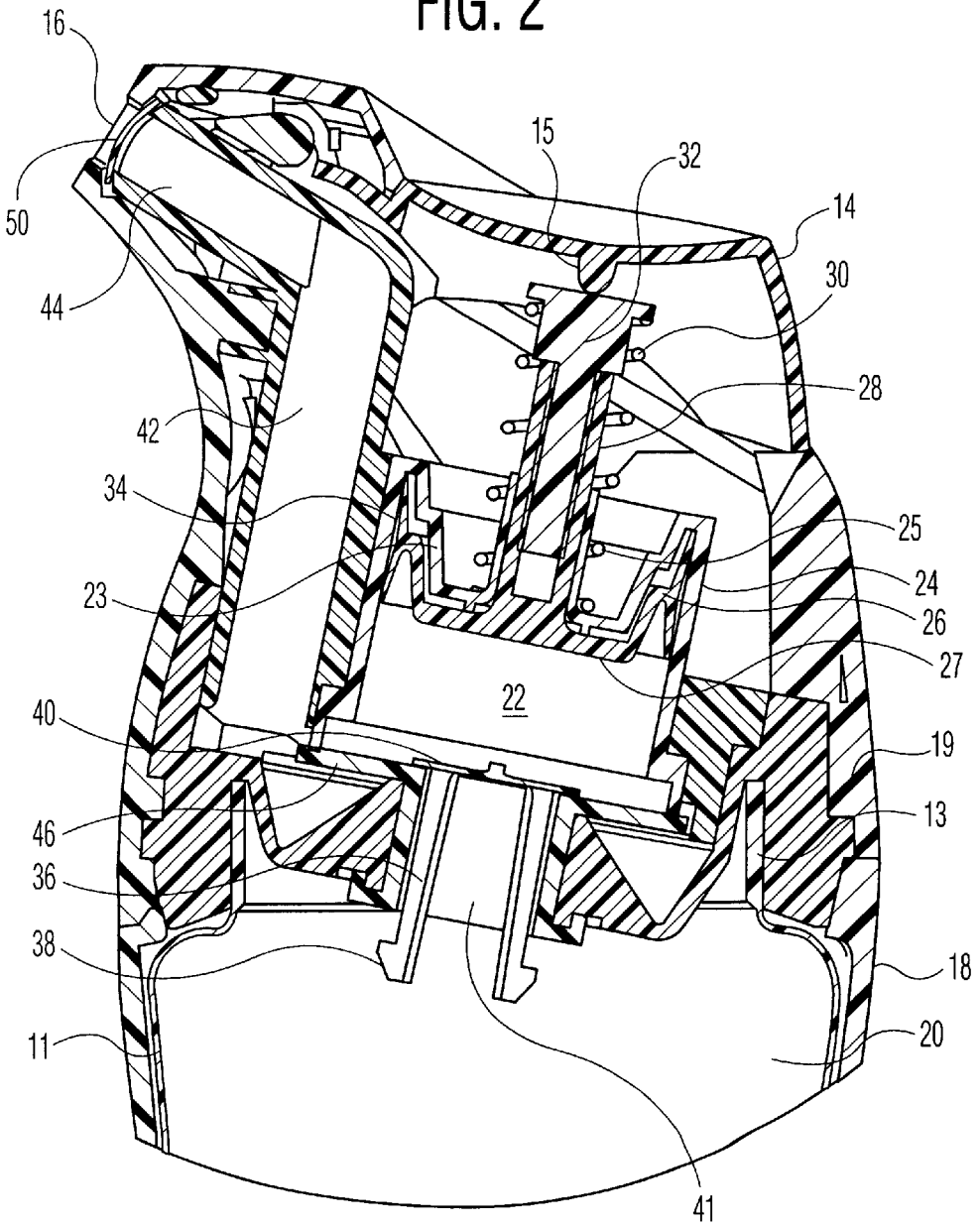
FIG. 3 is a partial elevation view of the dispenser in section along line 3—3 of FIG. 2.

FIG. 3 is a vertical sectional view of the pump portion of the dispenser 10. Chamber 20 contains the product to be dispensed and comprises container 11, which terminates in fitment 13. This container can be for one time use or can be replaceable. When replaceable, one can be removed and another, a refill, inserted. These will be removed and inserted through the bottom of the dispenser. The portion above product chamber 20 is the pump section. The sidewall 18 extends from the product chamber 20 to the sidewall 19 of the pump section. During dispensing product flows through aperture 41 that is closed by inlet valve 36. This inlet valve has travel limit stops 38 and an upper valve top 40, which opens and closes aperture 41. After the product passes by inlet valve 36 it flows into pump chamber 22. This pump chamber is formed by a lower wall of inlet valve 36 and outlet valve 46, pump chamber sidewall 24 and pump piston 26 as the upper wall. This pump piston rides along pump chamber wall 24. A piston shaft 28 extends up from piston base wall 27 and terminates in piston pad 32. Surrounding piston shaft 28 is spring 30. Actuator pad 15 contacts the piston pad 32 when actuator 14 is depressed. The piston shaft 28 rides in channel guide 25, which via wall 23 is a part of pump chamber wall 24.

As noted, outlet valve 46 also forms a lower part of the pump chamber 22. During dispensing outlet valve 46 extends downwardly to allow product from pump chamber 22 to flow to outlet channel 42 and outlet channel extension 44. Outlet channel extension 44 is closed by reciprocating closure 50, which closes outlet 16. This reciprocating closure 50 starts opening prior to product flow in the outlet channel extension and closes after product at the dispenser outlet has flowed back into the dispenser. However this closure 50 will assist in cutting off any product segment extending beyond the dispenser outlet. This will be the case for products that are stringy, i.e. have string-like segments extending from the main body of product that is flowing back into the outlet channel extension.

Figure 4A:
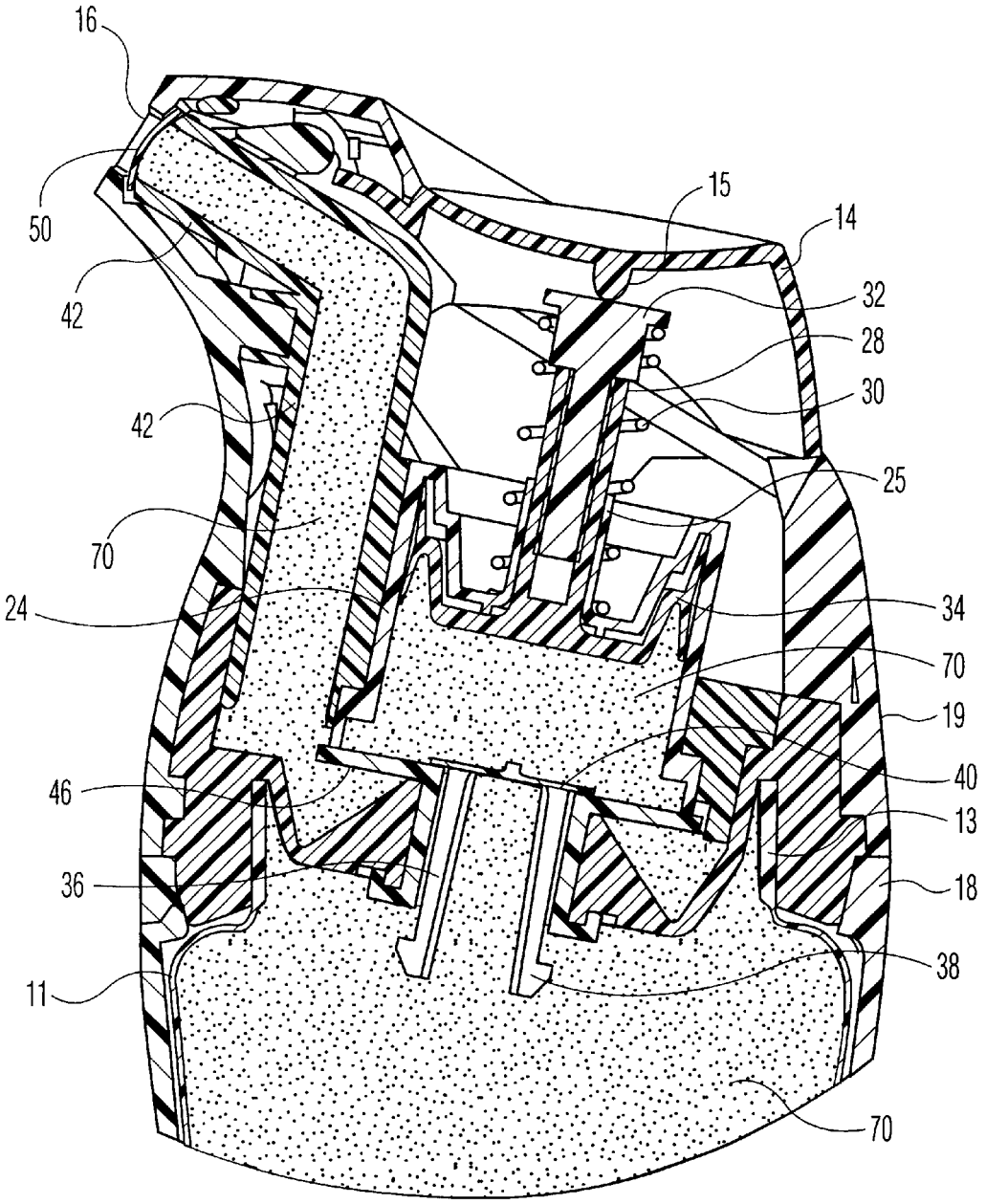
FIG. 4A is a partial elevation view of the dispenser as shown in FIG. 3 primed but prior to dispensing.
Figure 4B:
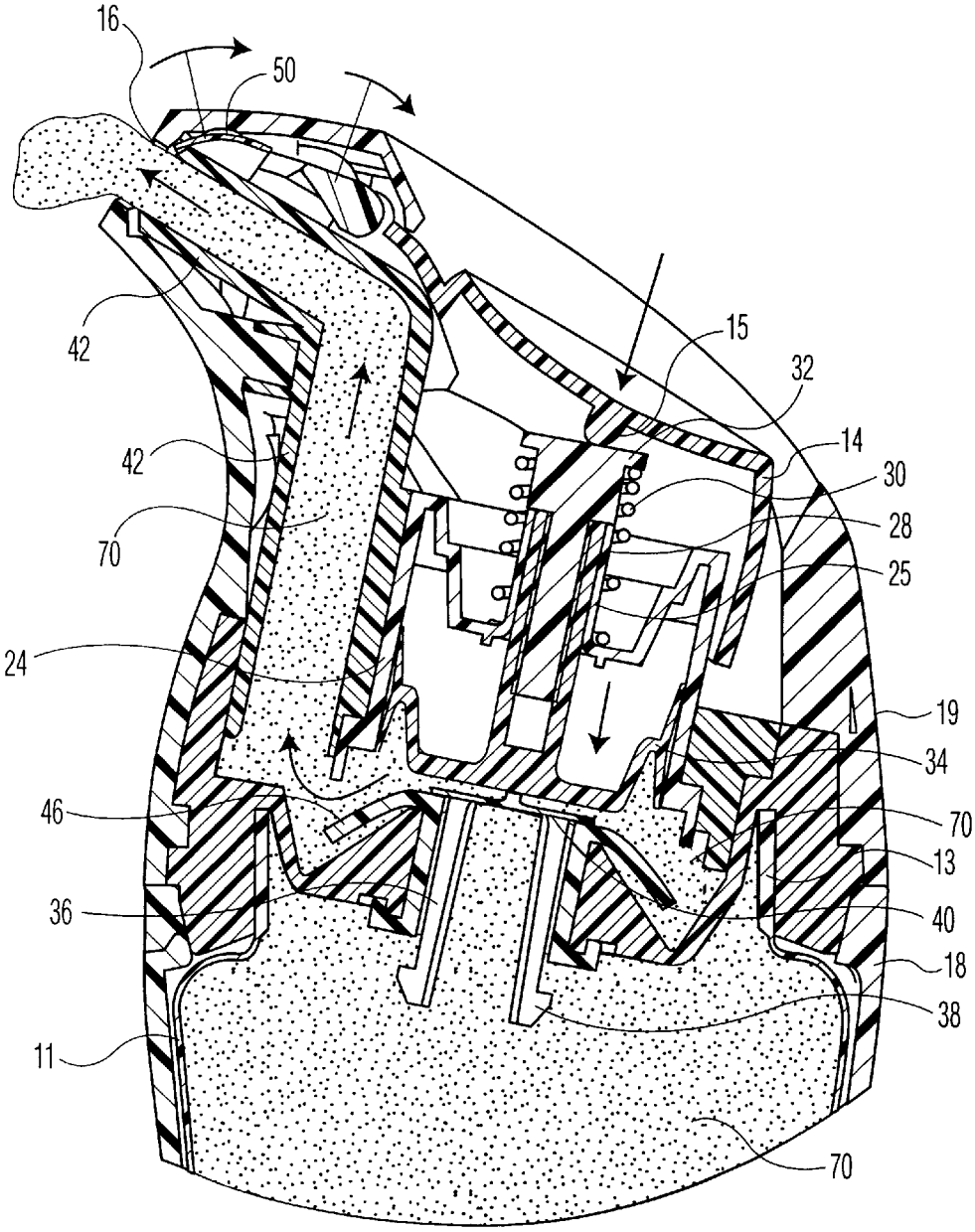
FIG. 4B is a partial elevation view of the dispenser as shown in FIG. 3 in the mode of dispensing.
Figure 4C:
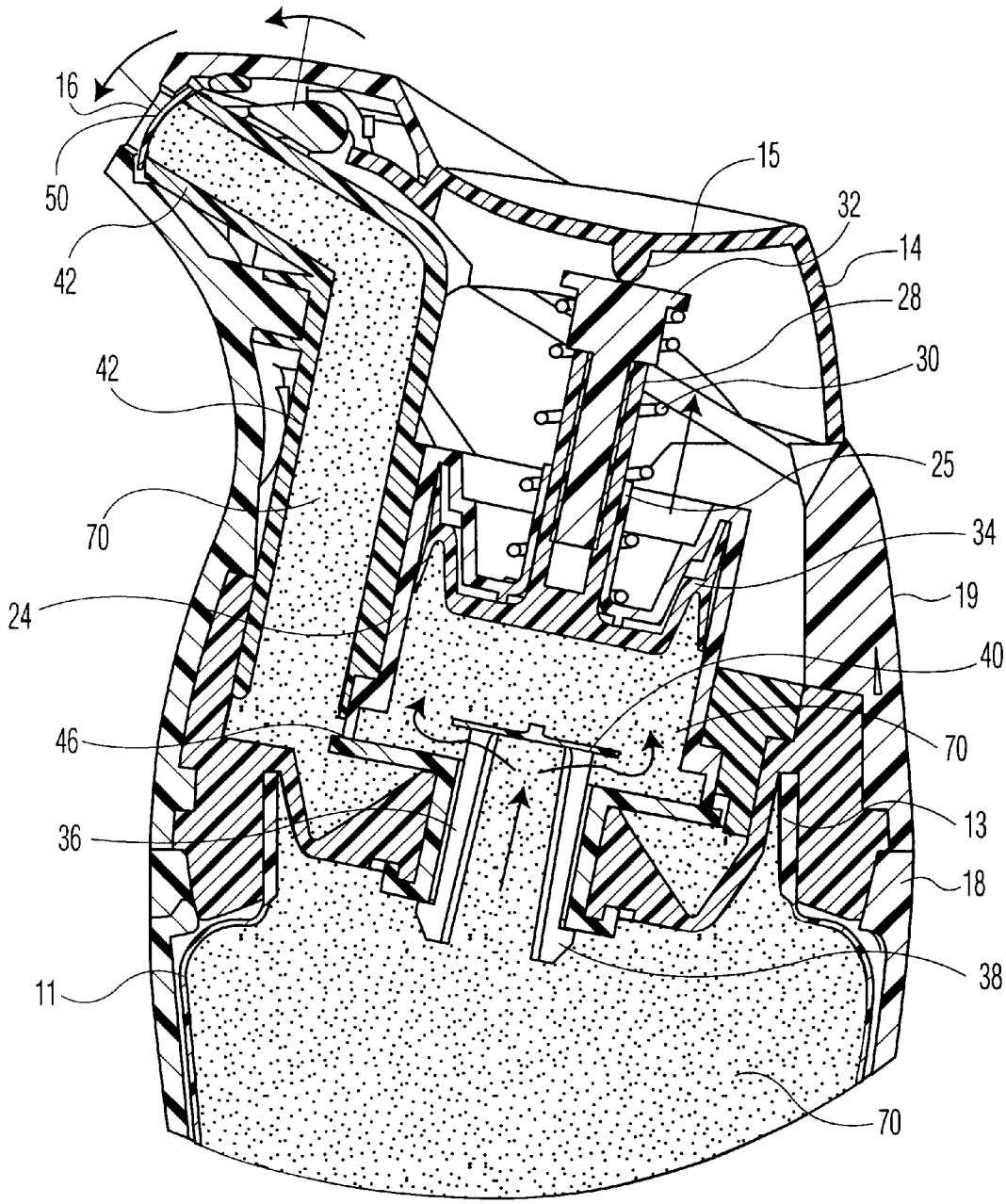
FIG. 4C is a partial elevation view of the dispenser as shown in FIG. 3 after the step of dispensing and with product being drawn into the pump chamber.

FIG. 4A shows the dispenser 10 primed for use, but in a rest condition. Product 70 is in the product chamber 20, pump chamber 22, outlet channel 42 and the outlet channel extension 44. FIG. 4B shows what occurs upon the actuation of the dispenser 10. Actuator 14 is depressed with actuator pad 15 contacting piston shaft pad 32. Piston 34 then moves downwardly displacing product 70 from pump chamber 22. The force put on product 70 in pump chamber 22 closes inlet valve 36 and forces outlet valve 46 to open allowing product 70 to flow up outlet channel 42 and through outlet channel extension 44 to the outlet 16. The closure 50 opens prior to the flow of product 70 from outlet channel extension 44 to the outlet. FIG. 4C shows the pump dispenser 10 returning to the rest position. As the downward force is released on actuator 14, it moves upwardly under the force of spring 30, which also pulls piston 34 upwardly. Upon piston 34 moving upwardly, inlet valve 36 is opened and product 70 flows up into pump chamber 22 due to the reduced pressure in pump chamber 22. Outlet valve 46 is closed most of this time. Inlet valve 36 will close as soon as piston 34 starts a downward stroke. This happens upon depressing actuator 14. However there is a slight delay in the opening of outlet valve 46. Closure 50 will open promptly upon piston 34 starting a downward stroke. In this way the closure is opening prior to the flow of product into the outlet channel.

A key feature that is built into the dispenser 10 is a suckback of product in outlet channel extension 44 upon the start of the actuator being returned to its rest position. As the piston is being retracted, outlet valve 46 remains open for a short period of time as inlet valve 36 is opening which allows product in outlet channel extension 44 to move downwardly away from outlet closure 50. This is a result of the reduced pressure in pump chamber 22. This prevents the build-up of product around closure 50.

Figure 5:
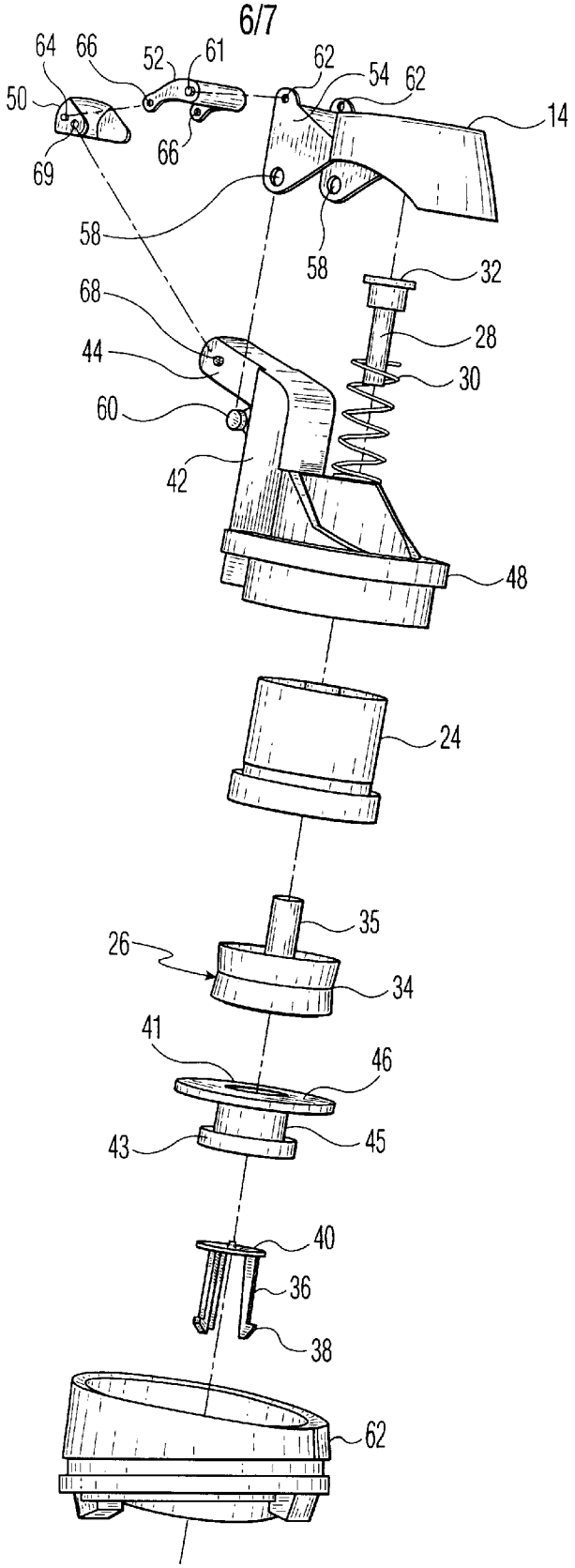
FIG. 5 is an exploded view of the pump head of the dispenser.

FIG. 5 shows the mechanics of the pump head in an exploded view. Starting at the lower end of the pump, there is valve holder 45. Inlet valve 36, which has valve top 40 and valve stops 38, fits into the outlet valve holder 45 and controls flow through aperture 41. Inlet valve top 40 contacts outlet valve top 46 with the inlet valve stop 38 contacting lower locking ridge 43 of outlet valve holder 45. The outlet valve top 46 flexes to function as a valve. Piston 26 has wiper walls 34 with piston shaft 35 extending upwardly. This piston 26 fits into pump chamber 22 defined by sidewall 24. Above pump chamber 22 is pump chassis 48. This pump chassis carries the actuator mechanism; the outlet channel 42 and outlet channel extension 44, and closure 50 with its actuating mechanism. The actuating mechanism is comprised of actuator 14, piston shaft 28 and piston shaft pad 32. The outlet channel 42 flows product outlet channel extension 44 and is a support for actuator hinge pin 60. Actuator hinge pin holder 58 fits onto actuator hinge pin 60 on each side. This then attaches actuator 14 to pump chassis 48. Closure hinge pin 68 Is mounted adjacent the end of outlet channel extension 44. Closure hinge pin holder 69 fits over closure hinge pin 68 at the end of the outlet channel extension 44 and attaches the closure to outlet extension 44. Closure connecting unit 52 attaches the closure 50 to the actuator 14. In this way the closure 50 opens prior to the movement of product 70 in the outlet channel extension 44. It also will not close outlet channel extension 44 with closure 50 until product 70 has been sucked back into the outlet channel extension about 3 mm to 8 mm.

The closure-connecting unit 52 has closure-connecting unit hinge pin 61, which fits into actuator hinge pin holders 62. On the other end of the closure-connecting unit 52 are closure connecting unit hinge pin holders 66. Closure hinge pins 64 will fit into connecting unit hinge pin holders 66. This is the structure of a preferred structure for the present pump section.

Figure 6:
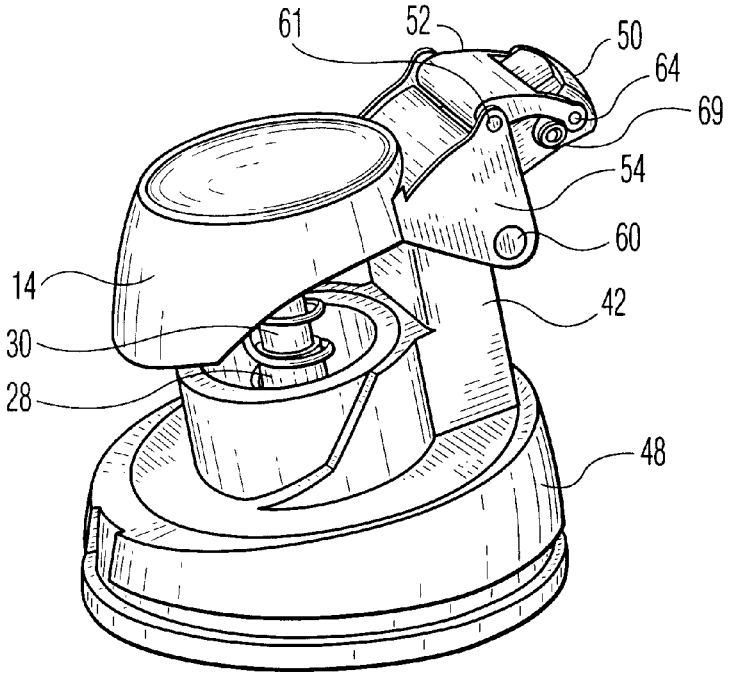
FIG. 6 is a partially assembled pump head in a non-dispensing mode.
Figure 7:
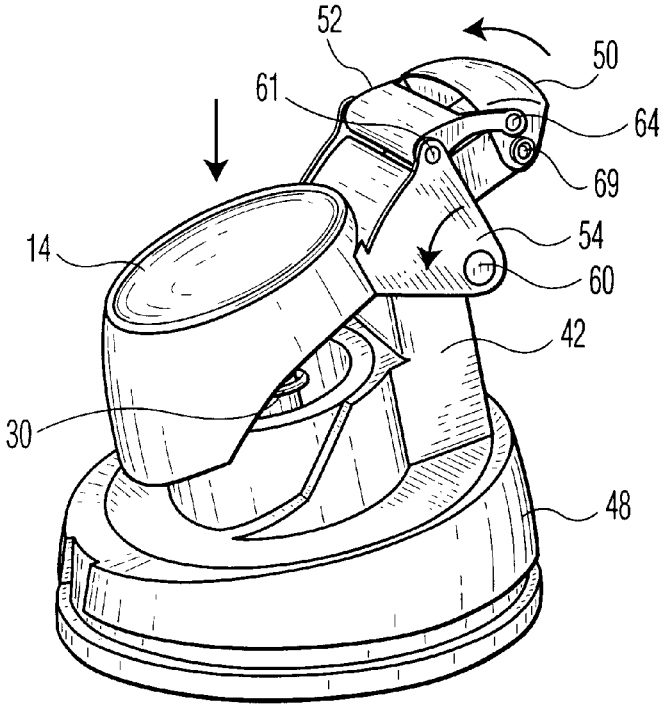
FIG. 7 is a partially assembled pump head in a dispensing mode.

FIG. 6 shows the pump mechanism at rest. The closure 50 is closing outlet 16. The spring 30 is fully extended. The closure mechanism with all connections of hinge pins to hinge pin holders is shown. FIG. 7 shows the pump mechanism actuated. It is shown here that when actuator 14 is depressed that it rotates around an actuator connecting hinge pin 60, pulling connecting unit 52 toward actuator 14 to open closure 50. The reverse occurs upon the release of actuator 14 until the pump mechanism reaches the rest state as shown in FIG. 6. As the actuator 14 is depressed, the door 50 is opened before the actuator 14 has been depressed to any significant extent. Upon depression of actuator 14, the actuator extension 54 rotates toward the actuator pulling connecting unit 52 in the same direction. This, then pivots closure 50 to be open. This is accomplished by means of the arrangement of hinge pins and hinge holders. The connecting unit rotates on hinge pin 61 and the closure, on hinge pin 64. The movement of these parts, upon depressing the actuator, causes the closure 50 to open with the opposite occurring when the pressure on the actuator is released. The opening is a prompt opening and the closing a delayed closing.

The dispenser can be constructed of a wide range of materials with thermoplastics being the material of choice. The spring usually would be metallic. The preferred thermoplastics are polyethylenes and polypropylenes. These materials usually are formed into the various parts by injection molding and extrusion molding. However, any known molding technique can be used. The dispenser parts can be hand or machine assembled. The type of assembly to be used will depends on the number of units to be made.

The product can be any viscous product but this dispenser is very useful in the dispensing of dentifrices. However this is a preferred product to be dispensed and is not limited to dispensing such products.

What is claimed is:

1. A dispenser for dispensing viscous products comprising a reservoir for said viscous product, a pump in communication with said reservoir and having an outlet channel for the dispensing of said viscous product, said outlet channel having an outlet exit, an actuator for actuating said pump, said actuator having a closure connected thereto by means of a connecting unit, said closure being attached to said outlet channel adjacent said outlet exit whereby when said actuator is depressed said closure is pivoted open prior to the flow of viscous product through said outlet channel to said outlet exit.

2. A dispenser as in claim 1 wherein said closure has a shape to cut off any viscous product extending from said outlet exit upon the cessation of dispensing.

3. A dispenser as in claim 1, wherein said actuator pivots on a hinge on said outlet channel.

4. A dispenser as in claim 3, wherein said hinge comprises a hinge pin located on a surface of said outlet channel adjacent an exterior wall of said dispenser.

5. A dispenser as in claim 3, wherein said connecting unit pivots at a first end around a hinge on said first end of said connecting unit.

6. A dispenser as in claim 5, wherein said closure pivots around a hinge adjacent said outlet exit of an outlet channel extension.

7. A dispenser as in claim 6, wherein said closure is attached to said connecting unit through a hinge on said second end of said connecting unit.

8. A dispenser as in claim 1, wherein said closure covers said outlet exit when said actuator is not being actuated.

9. A dispenser as in claim 1, wherein said pump is comprised of a pump chamber, a piston disposed in said pump chamber, an inlet to said pump chamber, an inlet valve disposed in said inlet to admit viscous product from said reservoir into said pump chamber, said outlet channel connected to said pump chamber, an outlet valve disposed between said pump chamber and said outlet channel, a piston shaft extending from said piston and being contacted by said actuator whereby when n said actuator is depressed to move said piston downwardly, said closure re is opened prior to viscous product being dispensed through said outlet exit.

10.The dispenser as in claim 9, wherein said actuator contacts said piston through said piston shaft, a spring substantially surrounding said piston shaft, said spring at one end contacting said pump chamber and at a second end, contacting said piston shaft adjacent said actuator, said spring returning said actuator and said piston to a rest position whereby viscous product is flowed from said reservoir into said pump chamber.

11. A dispenser as in claim 9 wherein said inlet valve is in a lower surface of said pump chamber, at least a part of said outlet valve surrounding said inlet valve.

12. A dispenser as in claim 11, wherein a peripheral portion of said lower surface comprises said outlet valve.

13. A dispenser as in claim 9 wherein a greater force is required to open the outlet valve than to close the inlet valve.

* * * * *